United States Patent [19]

Ramsey et al.

[11] Patent Number: 4,588,243

[45] Date of Patent: May 13, 1986

[54] DOWNHOLE SELF-ALIGNING LATCH SUBASSEMBLY

[75] Inventors: Mark S. Ramsey, Spring; Joseph W. Stolle, Wharton, both of Tex.

[73] Assignee: Exxon Production Research Co., Houston, Tex.

[21] Appl. No.: 565,449

[22] Filed: Dec. 27, 1983

[51] Int. Cl.[4] ..... H01R 13/20

[52] U.S. Cl. ..... 339/65; 339/16 R; 166/65.1

[58] Field of Search ..... 339/65, 66 R, 66 T, 339/66 M, 15, 16 R, 16 RC, 16 C; 340/853, 854, 855, 856, 857, 858; 166/65 R, 66

[56] References Cited

U.S. PATENT DOCUMENTS

| | | | |
|---|---|---|---|
| 3,649,949 | 3/1972 | McCarthy | 339/16 R |
| 3,976,347 | 8/1976 | Cooke, Sr. | 339/35 |
| 4,003,428 | 1/1977 | Zehren | 166/65 R |
| 4,039,237 | 8/1977 | Cullen et al. | 339/16 R |
| 4,073,341 | 2/1978 | Parker | 166/65 R |
| 4,129,184 | 12/1978 | Parker | 166/315 |
| 4,130,169 | 12/1978 | Denison | 166/65 R |
| 4,325,438 | 4/1982 | Zuvela | 166/65 R |
| 4,349,072 | 9/1982 | Escaron et al. | 166/250 |

FOREIGN PATENT DOCUMENTS 2094865 9/1982 United Kingdom .

*Primary Examiner*—Gil Weidenfeld
*Assistant Examiner*—Thomas M. Kline
*Attorney, Agent, or Firm*—E. Thomas Wheelock

[57] ABSTRACT

The invention relates to a self-cleaning, self-aligning, downhole make and break mechanical and electrical latch subassembly used in conjunction with logging vertical and deviated boreholes. The latch subassembly uses a pair of rings to self-align the male probe into the female receiver. A debris deflector surface and specially sized debris exit ports are provided to allow the mating of the parts without interference from extraneous downhole debris.

28 Claims, 3 Drawing Figures

DOWNHOLE SELF-ALIGNING LATCH SUBASSEMBLY

FIELD OF THE INVENTION

The invention relates to a self-cleaning, self-aligning, downhole make and break electrical and mechanical latch subassembly for use in logging both vertical and deviated boreholes and evaluating the subterranean formations found therein. The latch is used to connect a logging tool suite which is attached to the end of a drill string to surface instrumentation.

BACKGROUND OF THE INVENTION

The intentional drilling of directional boreholes began in South Africa nearly eighty years ago. A description of this process, by John Hoffman, is found in Bulletin 91 of the American Institute of Mining Engineers (Apr. 11, 1912). The method entailed sequentially drilling two straight but intersecting boreholes.

The technique of intentionally deviating the borehole of an oil well was first widely used in the 1920's or 1930's in the Huntington Beach field. Prior to invention of that technique, offshore wells were drilled from piers placed some distance from the shoreline. The number of piers began to impede ship traffic in some Pacific harbors and eventually led to the outlawing of such piers along some portions of the North American West Coast.

One driller's solution to the problem of outlawed piers entailed placing a rig on the shore and deviating the borehole to reach a producing formation offshore. Although the technique worked well, the driller's failure first to gain permission of either the state or the harbor authorities caused the technique to be disfavored.

However, the legitimate use of controlled directional drilling in shoreline drilling is not the only instance in which the process is useful.

Controlled directional drilling can be used to drill a borehole anywhere a surface obstruction prevents placement of the well site over the point where a well is to be bottomed out. The obstruction could be a hill, marsh, swamp, river, or freeway.

A deviated well may also be used to control another well which is burning or blowing formation fluids out of control. The deviated well is drilled to intersect a region near the borehole of the offending well. High pressure mud is pumped through the deviated borehole into the other borehole to control the formation fluids being lost to the fire or blowout.

Controlled deviated drilling techniques may be used in the optimization of reservoir pressure. For instance, if an initial well bottoms out in the upper end or gas cap of a producing formation, it may be wise to plug a lower portion of the well and deviate the borehole from the plugged point into a lower portion of the formation to recover liquid petroleum. Gas pressure in the cap is often the major driving force behind the petroleum liquids produced from the same formation. Production of the gas would lower its driving force on the liquid petroleum and ultimately lower the overall recovery from the formation.

Probably the most common instance of the use of controlled directionl drilling is found in the ubiquitous offshore platform. It is common to drill dozens of wells from a single platform. The expense of building an offshore platform for each well should be apparent to even the casual observer. In any event, the borehole for each well drilled from a platform typically follows a near vertical path to a specified depth into the sea bed and then quickly veers away from its neighboring wells.

Controlled directional drilling is not the only reason for the existence of deviated wellbores. The process of drilling obliquely from a soft geological layer into a relatively harder subterranean strata will cause the drill bit to serve from a vertical path. Similarly, insufficient drill collar weight on the lower end of the drill string will cause the bit to wander from the vertical during drilling. Neither situation is a desirable one and much care is taken by the driller to avoid their occurrence.

But whatever the reason for the existence of a deviated wellbore, the step of logging the wellbore once it has been drilled presents special challenges.

Logging a well is done to obtain a wide diversity of information using equally diverse types of instrumentation. In the normal course of events, the well is logged after drilling. Many wells require a number of logging runs to evaluate various wellbore intervals. The law of some locales, e.g., Norway, require that the entire length of the wellbore be logged. Drilling rigs are often rented on a daily basis and consequently anything subtracting from time available to drill is to be avoided. It occasionally may be necessary to log the well before the planned total depth ("TD") is attained to make sure that, e.g., a desired formation is penetrated. The surrounding wellbore formations are scanned to provide information concerning porosity, density, lithology, and characteristics of the formation fluids. Physical parameters of the borehole, such as its diameter, are measured so that subsequent casing and cementing steps may be efficiently completed.

There are two methods typically used for the physical step of placing a logging tool in the wellbore and then withdrawing it. The first method is practiced with the drill string out of the hole. A downhole tool or sonde, often weighin g several hundred pounds, is lowered in the open borehole upon a logging cable hanging from a pulley on the surface. If the borehole is vertical or nearly so, then gravity may take the logging sonde to the bottom of the hole. However, if the borehole has a dogleg or is otherwise deviated, reliance on gravity to carry the sonde to bottom is a questionable proposition. Even if the borehole is deviated, the overall logging costs may be minimized by first attempting this method of inserting the sonde and, if unsuccessful, proceeding to another method.

An improvement to the basic gravity impelled sonde is found in U.S. Pat. No. 4,031,750, Toyoumans el al. This logging instrument utilizes a linear electric motor attached to a set of vanes extending out from the instrument body. The sonde is dropped in the open borehole until it reaches a point where it no longer moves down. The electric motor is then actuated and the vanes reciprocate on the outside of the body and "rows" the device down the borehole. This apparatus apparently is not in wide use.

One logging method used after failure of the free-fall sonde method uses a drill string completely made up of drill pipe, i.e., having no drill collars or drill bit at its lower end. The open-ended drill string is generally run into the hole to a point below the region to be logged. A special logging sonde, having a very narrow diameter, is then attached to a logging cable and pumped down the drill string and out into the open hole below the drill string's lower end. The logging cable is connected to a recording instrument at the surface. The drill string is raised about 90 feet. The well in then logged by pulling the sonde up and recording the data it gathers. Once the sonde reaches the lower end of the drill pipe, data is no longer recorded and the sonde is pulled all the way to the surface through the drill string. A stand or treble (approximately 90') of pipe is remove from the string. The sonde is again inserted into the drill string and pumped out its lower end. This places the sonde at the point at which logging was terminated in the prior pass. The drill string is again pulled up about the length of a stand of pipe and the sonde subsequently follows it up logging the then-vacated ninety feet. The sonde, once again, is pulled to the surface and another stand of drill pipe removed from the string. This process is repeated ninety feet at a time until a sufficient amount of the wellbore is logged. Obviously this process is slowly and laborious. Only ninety feet of the well is logged with each pass.

A variation of this process, used when the wellbore has a nonvertical section which prevents insertion of a sonde to a desired interval but has a lower vertical leg, entails running the drill pipe down through the wellbore deviation and into the vertical region above the interval to be logged. The sonde is pumped out through the drill pipe and allowed to fall by gravity through the interval to be logged. Logging can then be carried out using the operation described above.

One method for increasing the length of wellbore logged with each pass of the sonde is found in U.S. Pat. No. 4,062,551, to Base. This process uses a short sub placed in drill string which allows the logging cable to pass through the drill string wall at some midpoint within the well. The well may be logged for a distance equal to the length of pipe between the pass-through sub and the surface before the sonde is pulled from the drill string. Some portion of the remaining drill string must then be pulled to re-install the pass-through sub in the drill string.

Similar suggestions for pass-through subs are found in U.S. Pat. No. 4,200,297 to Tricon, issued Apr. 29, 1980, and U.K. Patent Application GB No. 2,094,865A, to Institut Francais de Petrole ("IFP"), published Sept. 22, 1982. Both suggest using a drill string as the impetus for getting a sonde to the bottom of a borehole for logging purposes. Tricon, however, uses the drill stem to drive a drilling head; the drill stem does not rotate. IFP, on the other hand, uses a drill string as an upper part of a suite of logging tools to place the logging tools in a highly deviated portion of a borehole.

Another logging suite placed at the end of a series of drill pipe sections is disclosed in U.S. patent application No. 528,349 to Davis and Knight, filed Aug. 31, 1983.

Each of these devices required some manner of making and breaking electrical connection between the surface and the instrument package. IFP suggests one such connector having a female portion or socket which is pumped down on the end of a cable and further having a male portion or plug which is fixedly mounted above the tool string. Although IFP suggests that is device is especially suitable for use in deviated wells, at least one problem in operation would appear to occur when downhole debris is found in the path of the female portion. Drilled rock chips often gather on the deviated drill stem wall and may enter the pumped down socket. Similarly, debris would be expected to collect at the base of the plug portion. The electrical connection may be hard to make using the IFP connector under adverse circumstances.

Other connectors which are viewed as having similar problems are shown in U.S. Pat. No. 2,250,463 to Boynton, issued July 29, 1941; U.S. Pat. No. 3,976,347 to Cooke et al, issued Aug. 24, 1976; and U.S. Pat. No. 4,130,169 to Denison, issued Dec. 19, 1978.

SUMMARY OF THE INVENTION

The invention relates to a self-cleaning, self-aligning downhole repeat make and break electrical and mechanical latch subassembly. It is particularly useful for making electrical connections and logging deviated boreholes or boreholes having bridges, or other problems which effectively preclude the use of traditional wireline logging apparatus. The invention may of course by used in vertical boreholes.

Most problems which any latching device encounter centers around two distinct areas. The first is a simple matter of geometry. Proper alignment of all mating parts prior to and during engagement is crucial in most latch designs to a successful latching operation. When gross misalignment problems exist, extreme damage to mating services may occur. Even small alignment error will seriously degrade the integrity of the latch, especially when repeated make and break operations are attempted. Another prior area of concern is that of debris from other operations which may have taken place in the pipe prior to latching attempts. The debris will, depending upon the latch used, affect the latching operation in a negative fashion.

The present invention provides a simple solution to both of these problems. The latch is, of course, made up of two distinct parts. The first is a male portion or probe which is mounted so that it is in the center of the drill pipe or collar above the suite of logging tools located below it. The other, the mating piece, is lowered on a wire line in the drill pipe. The mating piece is made up of an overshot assembly having two alignment rings spaced down and away from the female electrical receptor. The leading edge of the first ring has a considerable taper so that the latch subassembly tends to ride on top of any debris that is encountered. The female receptor is placed within a protective cavity having an angled section just ahead of the electrical connection. Only a small opening through the angled section is needed. The probe is self-aligning through the two alignment rings. Further, should debris enter the protective chamber, substantial clearance remains inside the cavity to permit passage of the included debris through the cavity and back out into the open drill pipe.

DESCRIPTION OF THE PREFERRED EMBODIMENTS

Figure 1:
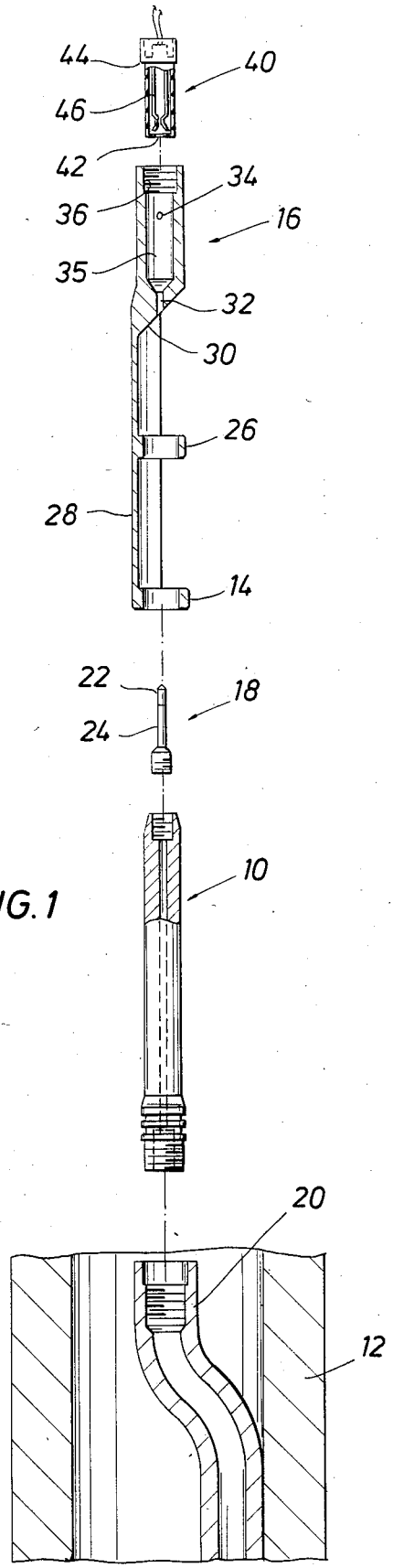
FIG. 1 gives an exploded, side, cutaway view of the inventive latch subassembly.

FIG. 1 is an exploded side view cutaway of the major parts of the inventive latch subassembly.

The male section or probe 10 is typically mounted in a drill pipe or drill collar 12 about the instrument package (not shown) in a suite of logging tools. The probe 10 has a sloping shoulder on its upper end to help align the probe with the leading ring 14 of the female latch receiver 16. The probe 10 is threaded to accept the male electrical connection 18. The lower end of probe 10 is also threaded to allow mounting in drill collar 12. An adaptor 20 is solidly attached to drill collar 12 and places the probe 10 rigidly in the approximate center of the drill collar. It should be apparent that other variations of the depicted adaptor would be just as suitable for positioning the probe in mid-pipe.

Male electrical connector 18 typically has an upper conductive section 22 and a lower insulative sleeve 24. Although the tool suite (discussed below with respect to FIG. 3) may have a number of logging devices, the gathered information may be multiplied. Consequently, a single conductor may be all that is needed for male electrical connector 18. An additional wire or cable (not shown) connects upper conductive section 22, via the passageways in probe 10 and adaptor 20, to the logging devices below in drill collar 12.

Female mating piece 16 is pumped down through the drill pipe when a connection is to be made. The mating piece 16 is made up of two portions. The first is an overshot portion comprising a leading ring 14, a middle ring 26, and a half tube extension 28. The other portion, an electrical connector receiver section, is made up of the debris deflection surface 30, the mating orifice 32, debris exit orifice 34, and mounting threads 36.

Figure 2:
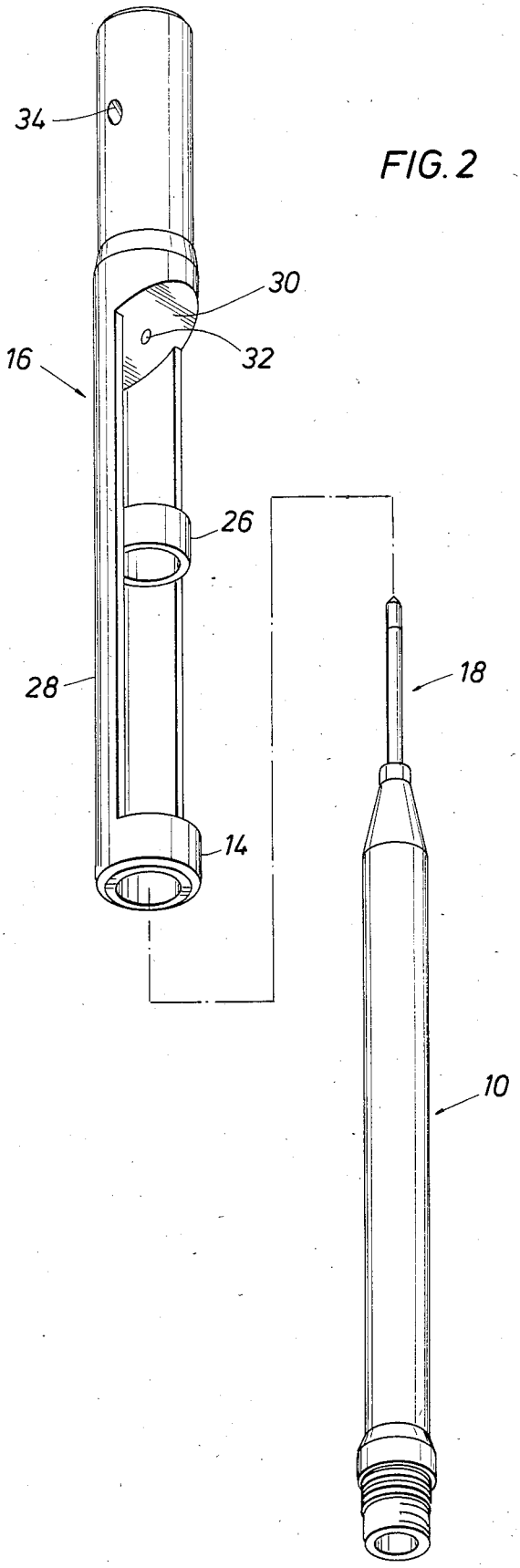
FIG. 2 is a perspective view of the latch subassembly.

The leading ring 14 may have a significant taper on its leading edge to permit the female portion of the latch substantially to ride on the top of any debris found in the drill pipe. A preferred way to accomplish this is to make the taper angle away from the ring center so that the radially inner edge of the taper is the furthest edge from the electrical connector receiver section. This is illustrated in FIG. 2. Since the half tube extension 28 is open, any debris entering the overshot assembly can readily escape. The probe 10 self-aligns with the mating piece 16 on the leading ring 14. Consequently, minor misalignments between the probe 10 and leading ring 14 are inconsequential. The inside diameter of both the leading ring 14 and the middle ring 26 should approximate the outside diameter of probe 10. However, the probe may be made up of two sections having different diameters. The larger diameter section would reside within leading ring 14 when the male electrical probe is seated. Alternatively, although less desirably, the probe may be slightly conical. The inside surface of the rings, again, should match the outside surface of the probe. The half tube extension 28 lends excellent rigidity to the assembly. The half tube extension may be slotted for additional debris clearance.

Any trash or debris which precedes the probe 10 through the leading ring 14 and middle ring 26 should be deflected by debris deflector surface 30. Only a small orifice 32 is provided for passage of male electrical connector 18. Most larger pieces of debris will not enter chamber 35 through orifice 32. Even those that enter should be able to exit through debris exit orifice or port 34. Port 34 should be angled to allow ease of fluid flow and should have a diameter larger than orifice 32 to permit debris which has entered chamber 35 to exit.

Female electrical receptor 40 is mounted inside chamber 35 with substantial clearance around the end nearest orifice 32. Mounting of the female electrical receptor 40 within chamber 35 of the female mating piece 16 is accomplished by mounting threads 36. Receptor 40 has a protective cover 42, a support base 44, and a spring contact 46. The protective cover 42 is perforated on the first electrical contact and will typically be filled with, e.g., a silicone-type grease, to protect the electrical connection after it is made. The protective cover is desirably made of a suitable elastomeric material which tightly seals around the male electrical connector 18. The protective cover helps preserve the integrity of the made-up electrical connection even after the grease has leaked out and drilling fluid is inside the cover. A design such as this will reliably allow multiple make and break electrical connections.

This inventive latch subassembly may be used as disclosed—that is to say—without additional mechanical latching means or it may be used with other known latching devices if the need arises.

FIG. 2 merely shows, in perspective, the relative positioning of the major parts of the inventive device. Probe 10 is shown with male electrical connector 18 attached.

Female mating piece 16 is shown with leading guide ring 14, middle ring 26, half tube extension 28, debris deflector surface 30, connector orifice 32, and debris exit orifice 34. The desirability of assuring that connector orifice 32 fall on a line connecting the centers of leading guide ring 14 and middle ring can be seen from this FIGURE.

Figure 3:
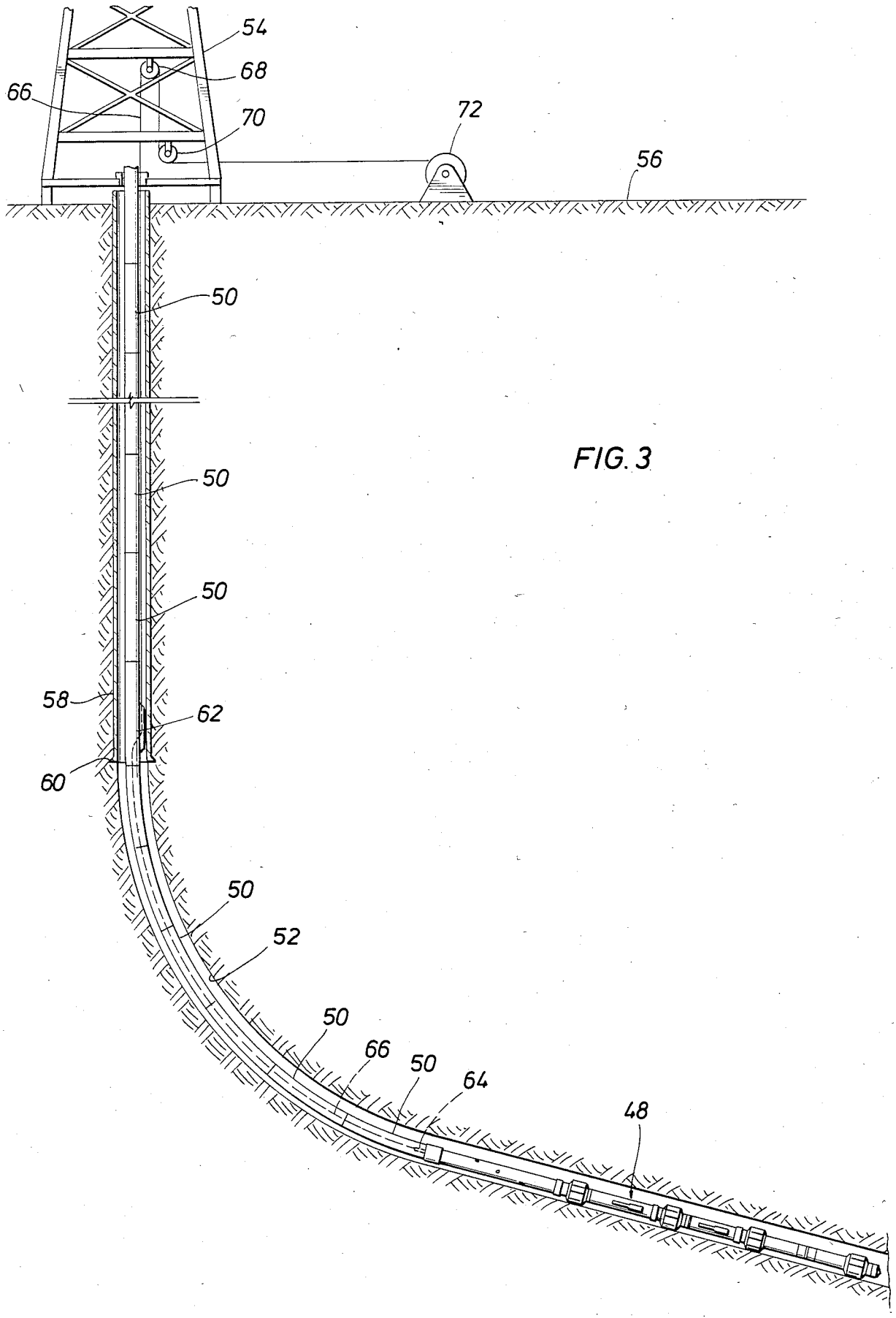
FIG. 3 shows, in schematic fashion, the step of logging a deviated borehole using an assembled tool suite located at the bottom end of the drill string.

FIG. 3 shows in schematic fashion, the manner in which a latch subassembly such as this would be used. Tool string 48 is installed at the bottom end of a string of drill pipe sections 50; these drill pipe sections are typically about 30 feet in length. The drill string is shown in a borehole 52 which is deviated nearly 70° from vertical. Since the inventive latch subassembly would normally be used to log a hole during the time drilling is proceeding or shortly after the well has been drilled to TD, a drilling rig 54 is shown at the surface 56. Borehole 52 has a string of casing 58 installed down to casing shoe 60. The remainder of the borehole below casing shoe 60 is open hole. A pass-through sub 62 is shown in the drill string located at the bottom of casing 58 near casing shoe 60. The pass-through or side entry sub 62 allows a logging cable to extend from tool string 48 by connector 64, such as that described herein, up through the interior of various drill pipe sections 50 out side entry sub 62 into the annular area between casing 58 and the drill pipe sections 50. As was discussed earlier in this specification, solid debris found in the drilling mud tends to collect on the low side of the drill pipe. The inventive latch assembly, which would make up at least a portion of connector 64, is specifically designed to ride over that debris and exclude it from the mating area of the connector. In any event, logging cable 66 then continues up out of the borehole and over a pair of sheaves 68 and 70 into a winch 72. For the purpose of clarity, the drill string handling equipment required for movement of the drill string and the surface safety equipment required both by prudence and law have not been depicted in drilling derrick 54. However, these devices are so well-known that no additional disclosure is considered necessary.

Pass-through or side entry sub 62 is shown at its lowest point. Although, for the purpose of the disclosed method, a number of different crossover subs would be acceptable, the preferable sub is shown in U.S. Pat. No. 468,532, filed Feb. 22, 1983, by A. P. Davis, O. M. Knight, and J. W. Stoltz. In order to protect the wire from the rigors of the open borehole, logging cable 66 normally would not be allowed to venture into the open hole below casing shoe 60. Consequently, the drill string shown in FIG. 3 is ready to log a portion of the hole upward from its depicted position to a point up the hole which is equal in distance as is the pass-through sub 62 from surface 56. The drill string is merely tripped out of the hole, logging is paused every 90 feet (a treble of drill pipe 50), the treble is removed from the string, logging is recommenced and continues until time comes for removal of another treble of drill pipe. This process continues until side entry sub 62 reaches the surface. At that time, side entry sub 62 is removed from the string and the logging cable withdrawn. If additional wellbore remains to be logged, an amount of drill pipe equal in length to the distance between casing shoe 60 and ground surface 56 is removed from the drill string and the side entry sub reinstalled in the string. The logging cable 66 is then pumped down the interior of the drill string through the side entry sub and latched with tool string connector 64. The tool string 48 is then run in to a position to log a previously unlogged portion of the borehole 52. This procedure is repeated until the entire zone of interest is logged.

This technique has a number of significant advantages. The tool string is made up of logging tools that are potentially of a very high resolution in that they need not be miniaturized to be pumped down within the interior of a drill string. The fact that a drill string is used to insert the tool string to the bottom allows very accurate depth correlation. The process should save drilling rig time in that the tools are positively placed by pushing, if necessary, rather than being passively inserted as is the case with wireline logging apparatus. The borehole need not be conditioned prior to running a sonde as is often the case with wireline logging apparatus. Wireline devices are susceptible to a number of problems in open boreholes, particularly those which are high angle. These problems can be summarized as washouts in which the tools fall and become lodged, doglegs, bridges, and ledges into which the tools nose during their downward path and lose momentum, mud balls, cutting buildups, or heavy muds, all of which impede the downward motion of the logging tool towards the bottom, and key seats found in the upper edge of the boreholes causing the logging tool to hang up upon removal.

It should be understood that the foregoing disclosure and description are only illustrative and explanatory of the invention. Various changes in and modifications to the components of the inventive device and the methods of using that device as well as in the details of the illustrated construction in processes may be made within the scope of the appended claims without departing from the spirit of the invention.

We claim in our invention:

1. A downhole latch subassembly comprising:

a male probe having a mounting end adapted to allow mounting said probe in a drill pipe, a connector end adapted to mount a male electrical connector, said probe having a longitudinal passageway between said mounting end and said connector end, a male electrical connector adapted to mount in said connector end of said male probe, a female mating piece having an overshot section and an electrical connector receiver section, said overshot section comprising two rings spaced a distance apart from each other and from the electrical connector receiver section, said rings adapted to receive said male probe and control passage of a male electrical connector through a path leading directly into a connector receiver orifice in said electrical connector receiver section, said electrical connector receiver section having a connector receiver orifice passing through a surface sloping with respect to the path of said male electrical connector mounted in said male probe and forming one end of said receiver section, said orifice facing said rings and opening into a receiver chamber positioned away from said rings, said receiver chamber including at least one debris exit port spaced away from said connector receiver orifice, said chamber adapted to receive a female electrical connector therein and having means for securing said female electrical connector therein, and a female electrical connector mounted within said receiver chamber and adapted to accept said male electrical connector through said connector receiver orifice.

2. The latch subassembly of claim 1 wherein said male electrical connector is screwed into said male probe.

3. The latch subassembly of claim 1 wherein said two rings are spaced from each other and from the electrical connector receiver section by a half tubular spacer.

4. The latch subassembly of claim 1 wherein said male probe is cylindrical and has a generally constant radius.

5. The latch subassembly of claim 1 wherein said male probe is generally cylindrical and has at least two separate portions, each having a separate radius.

6. The latch subassembly of claim 1 wherein the ring farthest from the connector receiver orifice has two ends, one end being nearer to said electrical connector receiver section, one end being remote, said remote end having a taper angled away from the ring center.

7. The latch subassembly of claim 6 wherein said taper of the remote edge of the ring farthest from the connector receiver orifice is angled at about 45° away from the ring center.

8. The latch subassembly of claim 1 wherein said sloping surface forming one end of said electrical connector receiver section is angled at about 45° to the path of the male electrical connector as it enters the connector receiver orifice.

9. The latch subassembly of claim 1 wherein said at least one debris exit port is angled at about 45° to the path of the male electrical connector as it enters the connector receiver orifice.

10. The latch subassembly of claim 9 wherein the diameter of said at least one debris exit port is greater than the diameter of the connector receiver orifice.

11. The latch subassembly of claim 1 wherein said female electrical connector is covered by a protective cover.

12. The latch subassembly of claim 11 wherein said protective cover is filled with a silicon-based grease.

13. A downhole latch subassembly comprising:

a male probe having a mounting end adapted to allow mounting said probe in a drill pipe, a connector end adapted to mount a male electrical connector, said probe having a longitudinal passageway between said mounting end and said connector end, and a female mating piece having an overshot section and an electrical connector receiver section, said overshot section comprising two rings spaced a distance apaet from each other and from the electrical connector receiver section, said rings adapted to receive said male probe and control passage of a male electrical connector mounted in said male probe through a path leading directly into a connector receiver orifice in the electrical connector receiver section, said electrical connector receiver section having a connector receiver orifice passing through a surface sloping with respect to the path of a male electrical connector mounted in said male probe and forming one end of said receiver section, said orifice facing said rings and opening into a receiver chamber positioned away from said rings, said receiver chamber including at least one debris exit port spaced away from said connector receiver orifice, said chamber adapted to receive a female electrical connector therein and having means for securing said female electrical connector therein.

14. The latch subassembly of claim 13 wherein said two rings are spaced from each other and from the electrical connector receiver section by a half tubular spacer.

15. The latch subassembly of claim 13 wherein said male probe is cylindrical and has a generally constant radius.

16. The latch subassembly of claim 13 wherein said male probe is generally cylindrical and has at least two separate portions, each having a separate radius.

17. The latch subassembly of claim 13 wherein the ring farthest from the connector receiver orifice has two ends, one end being nearer to said electrical connector receiver section, one end being remote, said remote end having a taper angled away from the ring center.

18. The latch subassembly of claim 17 wherein said taper of the remote edge of the ring farthest from the connector receiver orifice is angled at about 45° away from the ring center.

19. The latch subassembly of claim 13 wherein said sloping surface forming one end of said electrical connector receiver section is angled at about 45° to the path of a male electrical connector mounted on the male probe as said connector enters the connector receiver orifice.

20. The latch subassembly of claim 13 wherein said at least one debris exit port is angled at about 45° to the path of a male electrical connector mounted on the male probe as said connector enters the connector receiver orifice.

21. The latch subassembly of claim 20 wherein the diameter of said at least one debris exit port is greater than the diameter of the connector receiver orifice.

22. A downhole latch subassembly comprising:

a male probe having a mounting end adapted to allow mounting said probe in a drill pipe, a connector end adapted to mount a male electrical connector, said probe having a longitudinal passageway between said mounting end and said connector end, a male electrical connector mounted in said connector end of said male probe, a female mating piece having an overshot section and an electrical connector receiver section, said overshot section adapted to receive said male probe and control passage of said male electrical connector mounted in said male probe through a path leading directly into a connector receiver orifice in said electrical connector receiver section, said electrical connector receiver section having a connector receiver orifice passing through a surface sloping with respect to said path of a male electrical connector mounted in said male probe and forming one end of said receiver section, said orifice facing said overshot section and opening into a receiver chamber positioned away from said overshot section, said chamber adapted to receive a female electrical connector therein and having means for securing said female electrical connector therein, and said overshot section defining an opening adjacent to said sloping surface, said opening and said sloping surface being configured and oriented to cause any debris within said overshot section to be forced out of said overshot section throughout said opening in response to said male probe being inserted in said overshot section, and a female electrical connector mounted within said receiver chamber and adapted to accept said male electrical connector through said connector receiver orifice.

23. The latch subassembly of claim 22 wherein said male electrical connector is screwed into said male probe.

24. The latch subassembly of claim 22 wherein said male probe is cylindrical and has a generally constant radius.

25. The latch subassembly of claim 22 wherein said male probe is generally cylindrical and has at least two separate portions, each having a separate radius.

26. The latch subassembly of claim 22 wherein said sloping surface forming one end of said electrical connector receiver section is angled at about 45° to the path of the male electrical connector as it enters the connector receiver orifice.

27. The latch subassembly of claim 22 wherein said female electrical connector is covered by a protective cover.

28. The latch subassembly of claim 27 wherein said protective cover is filled with a silicon-based grease.

* * * * *